United States Patent [19]

Skinner et al.

[11] Patent Number: 4,743,317

[45] **Date of Patent: * May 10, 1988**

[54] ALUMINUM-TRANSITION METAL ALLOYS HAVING HIGH STRENGTH AT ELEVATED TEMPERATURES

[75] Inventors: David J. Skinner, Flanders; Paul A. Chipko, Madison; Kenji Okazaki, Basking Ridge, all of N.J.

[73] Assignee: Allied Corporation, Morris Township, Morris County, N.J.

[ * ] Notice: The portion of the term of this patent subsequent to Dec. 29, 2004 has been disclaimed.

[21] Appl. No.: 631,261

[22] Filed: Jul. 19, 1984

Related U.S. Application Data

[63] Continuation-in-part of Ser. No. 538,650, Oct. 3, 1983, abandoned.

[51] Int. Cl.[4] ..... C22C 21/00

[52] U.S. Cl. ..... 148/437; 75/249; 164/423; 164/463; 419/66

[58] Field of Search ..... 420/550; 75/249; 419/66; 148/437–440; 164/423, 463

[56] References Cited

U.S. PATENT DOCUMENTS 2,963,780 12/1960 Lyle, Jr. et al. ..... 29/182
2,966,731 1/1961 Towner et al. ..... 29/182

(List continued on next page)

FOREIGN PATENT DOCUMENTS 2471824 12/1979 France .
58-141837 (A) 11/1983 Japan .
1349452 9/1970 United Kingdom .
1362209 10/1971 United Kingdom .
2088409 11/1981 United Kingdom .

OTHER PUBLICATIONS

Business Communication by Marko Materials, Inc., 8/12/81.

P. P. Millan, Jr., "Applications of High-Temperature Powder Aluminum Alloys to Small Gas Turbines", Mar. 1983, pp. 76–81.

(List continued on next page)

*Primary Examiner*—R. Dean

*Attorney, Agent, or Firm*—Ernest D. Buff; Gerhard H. Fuchs

[57] ABSTRACT

The invention provides an aluminum based alloy consisting essentially of the formula $Al_{bal}Fe_aX_b$, wherein X is at least one element selected from the group consisting of Zn, Co, Ni, Cr, Mo, V, Zr, Ti, Y, Si and Ce, "a" ranges from about 7–15 wt %, "b" ranges from about 1.5–10 wt % and the balance is aluminum. The alloy has a predominately microeutectic microstructure.

The invention also provides a method and apparatus for forming rapidly solidified metal, such as the metal alloys of the invention, within an ambient atmosphere. Generally stated, the apparatus includes a moving casting surface which has a quenching region for solidifying molten metal thereon. A reservoir holds molten metal and has orifice means for depositing a stream of molten metal onto the casting surface quenching region. A heating mechanism heats the molten metal contained within the reservoir, and a gas source provides a non-reactive gas atmosphere at the quenching region to minimize oxidation of the deposited metal. A conditioning mechanism disrupts a moving gas boundary layer carried along by the moving casting surface to minimize disturbances of the molten metal stream that would inhibit quenching of the molten metal on the casting surface at a quench rate of at least about $10^{6°}$ C./sec.

Particles composed of the alloys of the invention can be heated in a vacuum and compacted to form a consolidated metal article have high strength and good ductility at both room temperature and at elevated temperatures of about 350° C. The consolidated article is composed of an aluminum solid solution phase containing a substantially uniform distribution of dispersed intermetallic phase precipitates therein. These precipitates are fine intermetallic measuring less than about 100 nm in all dimensions thereof.

19 Claims, 7 Drawing Sheets

U.S. PATENT DOCUMENTS

| | | | |
|---|---|---|---|
| 2,966,732 | 1/1961 | Towner et al. | 29/182 |
| 2,966,733 | 1/1961 | Towner et al. | 29/182 |
| 2,966,734 | 1/1961 | Towner et al. | 29/182 |
| 2,966,735 | 1/1961 | Towner et al. | 29/182 |
| 2,966,736 | 1/1961 | Towner et al. | 29/182 |
| 2,967,351 | 1/1961 | Roberts et al. | 29/420.5 |
| 2,994,947 | 8/1961 | Towner et al. | 29/182 |
| 3,004,331 | 10/1961 | Towner et al. | 29/182 |
| 3,462,248 | 8/1969 | Roberts et al. | 29/182 |
| 3,625,677 | 12/1968 | Jones | 75/138 |
| 3,899,820 | 8/1975 | Read et al. | 29/420.5 |
| 4,282,921 | 8/1981 | Liebermann | 164/463 |
| 4,347,076 | 8/1982 | Ray et al. | 75/249 |
| 4,379,719 | 4/1983 | Hildeman et al. | 420/550 |

OTHER PUBLICATIONS

C. M. Adam, "Structure/Property Relationships and Applications of Rapidly Solidified Aluminum Alloys", Copyright 1982, pp. 411–422.

H. Jones, "Observations on a Structural Transition in Aluminum Alloys Hardened by Rapid Solidification", Mar. 1969, pp. 1–18.

M. H. Jacobs, et al., "A Study of Microstructure and Phase Transformations in an Annealed, Rapidly Quenched, Al–8 wt % Fe Alloy", 1970, pp. 18.1–18.16.

G. Thursfield, et al., "Elevated Temperature Mechanical Properties of a Rapidly Quenched Al–8 wt % Fe Alloy", 1970, pp. 19.1–19.6.

AS CAST

300°C - 1 HR.

350°C - 1 HR.

400°C - 1 HR.

450°C - 1 HR.

6: Microhardness as a function of isochronal annealing temperature for rapidly solidified aluminum alloys

AL-12 FE-2V AS EXTRUDED

ALUMINUM-TRANSITION METAL ALLOYS HAVING HIGH STRENGTH AT ELEVATED TEMPERATURES

CROSS REFERENCE TO RELATED APPLICATIONS

This is a continuation-in-part of U.S. application Ser. No. 538,650 filed Oct. 3, 1983, now abandoned.

FIELD OF THE INVENTION

The invention relates to aluminum alloys having high strength at elevated temperatures, and relates to powder products produced from such alloys. More particularly, the invention relates to aluminum alloys having sufficient engineering tensile ductility for use in high temperatures structural applications which require ductility, toughness and tensile strength.

BRIEF DESCRIPTION OF THE PRIOR ART

Methods for obtaining improved tensile strength at 350° C. in aluminum based alloys have been described in U.S. Pat. No. 2,963,780 to Lyle, et al.; U.S. Pat. No. 2,967,351 to Roberts, et al.; and U.S. Pat. No. 3,462,248 to Roberts, et al. The alloys taught by Lyle, et al. and by Roberts, et al. were produced by atomizing liquid metals into finely divided droplets by high velocity gas streams. The droplets were cooled by convective cooling at a rate of approximately $10^4$° C./sec. As a result of this rapid cooling, Lyle, et al. and Roberts, et al. were able to produce alloys containing substantially higher quantities of transition elements than had theretofore been possible.

Higher cooling rates using conductive cooling, such as splat quenching and melt spinning, have been employed to produce cooling rates of about $10^6$ to $10^7$° C./sec. Such cooling rates minimize the formation of intermetallic precipitates during the solidification of the molten aluminum alloy. Such intermetallic precipitates are responsible for premature tensile instability. U.S. Pat. No. 4,379,719 to Hildeman, et al. discusses rapidly quenched, aluminum alloy powder containing 4 to 12 wt % iron and 1 to 7 wt % Ce or other rare earth metal from the Lanthanum series. U.S. Pat. No. 4,347,076 to Ray, et al. discusses high strength aluminum alloys for use at temperatures of about 350° C. that have been produced by rapid solidification techniques. These alloys, however, have low engineering ductility at room temperature which precludes their employment in structural applications where a minimum tensile elongation of about 3% is required. An example of such an application would be in small gas turbine engines discussed by P. T. Millan, Jr.; *Journal of Metals*, Volume 35 (3), 1983, page 76.

Ray, et al. discusses a method for fabricating aluminum alloys containing a supersaturated solid solution phase. The alloys were produced by melt spinning to form a brittle filament composed of a metastable, face-centered cubic, solid solution of the transition elements in the aluminum. The as-cast ribbons were brittle on bending and were easily comminuted into powder. The powder was compacted into consolidated articles having tensile strengths of up to 76 ksi at room temperature. The tensile ductility of the alloys was not discussed in Ray, et al. However, it is known that many of the alloys taught by Ray, et al., when fabricated into engineering test bars, do not possess sufficient ductility for use in structural components.

Thus, conventional aluminum alloys, such as those taught by Ray, et al., have lacked sufficient engineering ductility. As a result, these conventional alloys have not been suitable for use in structural components.

SUMMARY OF THE INVENTION

The invention provides an aluminum based alloy consisting essentially of the formula $Al_{bal}Fe_aX_b$, wherein X is at least one element selected from the group consisting of Zn, Co, Ni, Cr, Mo, V, Zr, Ti, Y, Si and Ce, "a" ranges from about 7–15 wt %, "b" ranges from about 1.5–10 wt % and the balance is aluminum. The alloy has a predominately microeutectic microstructure.

The invention also provides a method and apparatus for forming rapidly solidified metal, such as the metal alloys of the invention, within an ambient atmosphere. Generally stated, the apparatus includes a moving casting surface which has a quenching region for solidifying molten metal thereon. A reservior means holds molten metal and has orifice means for depositing a stream of molten metal onto the casting surface quenching region. Heating means heat the molten metal contained within the reservoir, and gas means provide a non-reactive gas atmosphere at the quenching region to minimize oxidation of the deposited metal. Conditioning means disrupt a moving gas boundary layer carried along by the moving casting surface to minimize disturbances of the molten metal stream that would inhibit quenching of the molten metal on the casting surface at a rate of at least about $10^6$° C./sec.

The apparatus of the invention is particularly useful for forming rapidly solidified alloys of the invention having a microstructure which is almost completely microeutectic. The rapid movement of the casting surface in combination with the conditioning means for disrupting the high speed boundary layer carried along by the casting surface advantageously provides the conditions needed to produce the distinctive microeutectic microstructure within the alloy. Since the cast alloy has a microeutectic microstructure it can be processed to form particles that, in turn, can be compacted into consolidated articles having an advantageous combination of high strength and ductility at room temperature and elevated temperatures. Such consolidated articles can be effectively employed as structural members.

The invention further provides a method for forming a consolidated metal alloy article. The method includes the step of compacting particles composed of an aluminum based alloy consisting essentially of the formula $Al_{bal}Fe_aX_b$. X is at least one element selected from the group consisting of Zn, Co, Ni, Cr, Mo, V, Zr, Ti, Y, Si and Ce. "a" ranges from about 7–15 wt %, "b" ranges from about 1.5–10 wt % and the balance of the alloy is aluminum. The alloy particles have a microstructure which is at least about 70% microeutectic. The particles are heated in a vacuum during the compacting step to a pressing temperature ranging from about 300 to 500° C., which minimizes coarsening of the dispersed, intermetallic phases.

Additionally, the invention provides a consolidated metal article compacted from particles of the aluminum based alloy of the invention. The consolidated article of the invention is composed of an aluminum solid solution phase containing a substantially uniform distribution of dispersed, intermetallic phase precipitates therein.

These precipitates are fine, intermetallics measuring less than about 100 nm in all dimensions thereof. The consolidated article has a combination of an ultimate tensile strength of approximately 275 MPa (40 ksi) and sufficient ductility to provide an ultimate tensile strain of at least about 10% elongation when measured at a temperature of approximately 350° C.

Thus, the invention provides alloys and consolidated articles which have a combination of high strength and good ductility at both room temperature and at elevated temperatures of about 350° C. As a result, the consolidated articles of the invention are stronger and tougher than conventional high temperature aluminum alloys, such as those taught by Ray, et al. The articles are more suitable for high temperature applications, such as structural members for gas turbine engines, missiles and air frames.

BRIEF DESCRIPTION OF THE DRAWINGS

The invention will be more fully understood and further advantages will become apparent when reference is made to the following detailed description of the preferred embodiment of the invention and the accompanying drawings in which.

DESCRIPTION OF THE PREFERRED EMBODIMENTS

Figure 1:
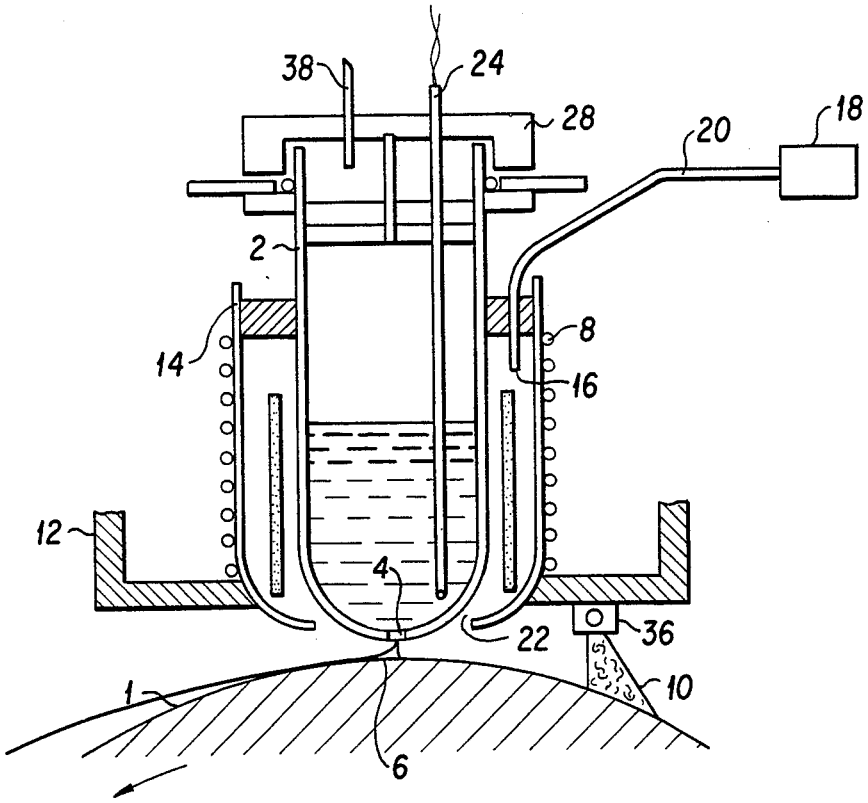
FIG. 1 shows a schematic representation of the casting apparatus of the invention.

FIG. 1 illustrates the apparatus of the invention. A moving casting surface 1 is adapted to quench and solidify molten metal thereon. Reservoir means, such as crucible 2, is located in a support 12 above casting surface 1 and has an orifice means 4 which is adapted to deposit a stream of molten metal onto a quenching region 6 of casting surface 1. Heating means, such as inductive heater 8, heats the molten metal contained within crucible 2. Gas means, comprised of gas supply 18 and housing 14 provides a non-reactive gas atmosphere to quenching region 6 which minimizes the oxidation of the deposited metal. Conditioning means, located upstream from crucible 2 in the direction counter to the direction of motion of the casting surface, disrupts the moving gas boundary layer carried along by moving casting surface 1 and minimizes disturbances of the molten metal stream that would inhibit the desired quenching rate of the molten metal on the casting surface.

Casting surface 1 is typically a peripheral surface of a rotatable chill roll or the surface of an endless chilled belt constructed of high thermal conductivity metal, such as steel or copper alloy. Preferably, the casting surface is composed of a Cu-Zr alloy.

Figure 3:
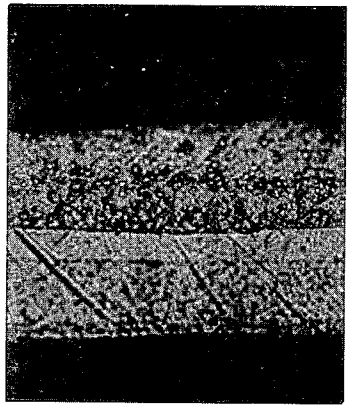
FIG. 3 shows a photomicrograph of an alloy which has not been adequately quenched at a uniform rate.

To rapidly solidify molten metal alloy and produce a desired microstructure, the chill roll or chill belt should be constructed to move casting surface 1 at a speed of at least about 4000 ft/min (1200 m/min), and preferably at a speed ranging from about 6500 ft/min (2000 m/min) to about 9,000 ft/min (2750 m/min). This high speed is required to provide uniform quenching throughout a cast strip of metal, which is less than about 40 micrometers thick. This uniform quenching is required to provide the substantially uniform, microeutectic microstructure within the solidified metal alloy. If the speed of the casting surface is less than about 1200 m/min, the solidified alloy has a heavily dendritic morphology exhibiting large, coarse precipitates, as a representatively shown in FIG. 3.

Crucible 2 is composed of a refractory material, such as quartz, and has orifice means 4 through which molten metal is deposited onto casting surface 1. Suitable orifice means include a single, circular jet opening, multiple jet openings or a slot type opening, as desired. Where circular jets are employed, the preferred orifice size ranges from about 0.1–0.15 centimeters and the separation between multiple jets is at least about 0.64 centimeters. Thermocouple 24 extends inside crucible 2 through cap portion 28 to monitor the temperature of the molten metal contained therein. Crucible 2 is preferably located about 0.3–0.6 centimeters above casting surface 1, and is oriented to direct a molten metal stream that deposits onto casting surface 1 at an deposition approach angle that is generally perpendicular to the casting surface. The orifice pressure of the molten metal stream preferably ranges from about 1.0–1.5 psi (6.89–7.33 kPa).

It is important to minimize undesired oxidation of the molten metal stream and of the solidified metal alloy. To accomplish this, the apparatus of the invention provides an inert gas atmosphere or a vacuum within crucible 2 by way of conduit 38. In addition, the apparatus employs a gas means which provides an atmosphere of non-reactive gas, such as argon gas, to quenching region 6 of casting surface 1. The gas means includes a housing 14 disposed substantially coaxially about crucible 2. Housing 14 has an inlet 16 for receiving gas directed from pressurized gas supply 18 through conduit 20. The received gas is directed through a generally annular outlet opening 22 at a pressure of about 30 psi (207 kPa) toward quenching region 6 and floods the quenching region with gas to provide the non-reactive atmosphere. Within this atmosphere, the quenching operation can proceed without undesired oxidation of the molten metal or of the solidified metal alloy.

Since casting surface 1 moves very rapidly at a speed of at least about 1200 to 2750 meters per minute, the casting surface carries along an adhering gas boundary layer and produces a velocity gradient within the atmosphere in the vicinity of the casting surface. Near the casting surface the boundary layer gas moves at approximately the same speed as the casting surface; at positions further from the casting surface, the gas velocity gradually decreases. This moving boundary layer can strike and destabilize the stream of molten metal coming from crucible 2. In severe cases, the boundary layer blows the molten metal stream apart and prevents the desired quenching of the molten metal. In addition, the boundary layer gas can become interposed between the casting surface and the molten metal to provide an insulating layer that prevents an adequate quenching rate. To disrupt the boundary layer, the apparatus of the invention employs conditioning means located upstream from crucible 2 in the direction counter to the direction of casting surface movement.

In a preferred embodiment of the invention, a conditioning means is comprised of a gas jet 36, as representatively shown in FIG. 1. In the shown embodiment, gas jet 36 has a slot orifice oriented approximately parallel to the transverse direction of casting surface 1 and perpendicular to the direction of casting surface motion. The gas jet is spaced upstream from crucible 2 and directed toward casting surface 1, preferably at a slight angle toward the direction of the oncoming boundary layer. A suitable gas, such as nitrogen gas, under a high pressure of about 800–900 psi (5500–6200 kPa) is forced through the jet orifice to form a high velocity gas "knife" 10 moving at a speed of about 300 m/sec that strikes and disperses the boundary layer before it can reach and disturb the stream of molten metal. Since the boundary layer is disrupted and dispersed, a stable stream of molten metal is maintained. The molten metal is uniformly quenched at the desired high quench rate of at least about $10^{6}$° C./sec, and preferably at a rate greater than $10^{6}$° C./sec to enhance the formation of the desired microeutectic microstructure.

Figure 2:
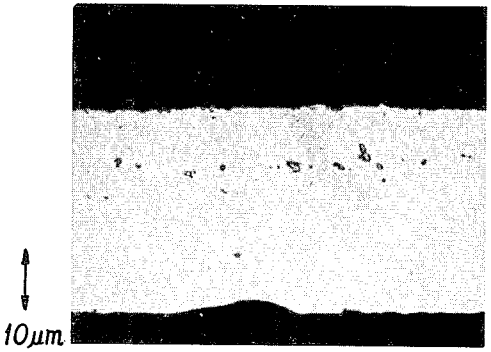
FIG. 2 shows a photomicrograph of an alloy quenched in accordance with the method and apparatus of the invention.

The apparatus of the invention is particularly useful for producing high strength, aluminum-based alloys, particularly alloys consisting essentially of the formula $Al_{bal}Fe_aX_b$, wherein X is at least one element selected from the group consisting of Zn, Co, Ni Cr, Mo, V, Zr, Ti, Y, Si and Ce, "a" ranges from about 7–15 wt %, "b" ranges from about 1.5–10 wt % and the balance is aluminum. Such alloys have high strength and high hardness; the microVickers hardness is at least about 320 kg/mm$^2$. To provide an especially desired combination of high strength and ductility at temperatures up to about 350° C., "a" ranges from about 10–12 wt % and "b" ranges from about 1.5–8 wt %. In alloys cast by employing the apparatus and method of the invention, optical microscopy reveals a uniform featureless morphology when etched by the conventional Kellers etchant. See, for example, FIG. 2. However, alloys cast without employing the method and apparatus of the invention do not have a uniform morphology. Instead, as representatively shown in FIG. 3, the cast alloy contains a substantial amount of very brittle alloy having a heavily dendritic morphology with large coarse precipitates.

The inclusion of about 0.5–2 wt % Si in certain alloys of the invention can increase the ductility and yield strength of the as-consolidated alloy when those alloys are extruded in the temperature range of about 375°–400° C. For example, such increase in ductility and yield strength has been observed when Si was added to Al-Fe-V compositions and the resultant Al-Fe-V-Si, rapidly solidified alloy extruded within the 375°–400° C. temperature range.

Figure 4:
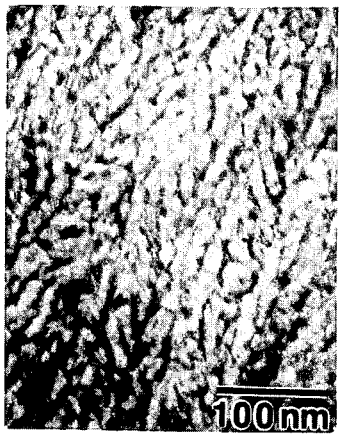
FIG. 4 shows a transmission electron micrograph of an as-cast aluminum alloy having a microeutectic microstructure.

The alloys of the invention have a distinctive, predominately microeutectic microstructure (at least about 70% microeutectic) which improves ductility, provides a microVickers hardness of at least about 320 kg/mm$^2$ and makes them particularly useful for constructing structural members employing conventional powder metallurgy techniques. More specifically, the alloys of the invention have a hardness ranging from about 320–700 kg/mm$^2$ and have the microeutectic microstructure representatively shown in FIG. 4.

This microeutectic microstructure is a substantially two-phase structure having no primary phases, but composed of a substantially uniform, cellular network (lighter colored regions) of a solid solution phase containing aluminum and transition metal elements, the cellular regions ranging from about 30 to 100 nanometers in size. The other, darker colored phase, located at the edges of the cellular regions, is comprised of extremely stable precipitates of very fine, binary or ternary, intermetallic phases. These intermetallics are less than about 5 nanometers in their narrow width dimension and are composed of aluminum and transition metal elements (AlFe, AlFeX). The ultrafine, dispersed precipitates include, for example, metastable variants of AlFe with vanadium and zirconium in solid solution. The intermetallic phases are substantially uniformly dispersed within the microeutectic structure and intimately mixed with the aluminum solid solution phase, having resulted from a eutectic-like solidification. To provide improved strength, ductility and toughness, the alloy preferably has a microstructure that is at least 90% microeutectic. Even more preferably, the alloy is approximately 100% microeutectic.

This microeutectic microstructure is retained by the alloys of the invention after annealing for one hour at temperatures up to about 350° C. (660° F.) without significant structural coarsening, as representatively shown in FIG. 5(*a*), (*b*). At temperatures greater than about 400° C. (750° F.), the microeutectic microstructure decomposes to the aluminum alloy matrix plus fine (0.005 to 0.05 micrometer) intermetallics, as representatively shown in FIG. 5(*c*), the exact temperature of the decomposition depending upon the alloy composition and the time of exposure. At longer times and/or higher temperatures, these intermetallics coarsen into spherical or polygonal shaped dispersoids typically ranging from about 0.1–0.05 micrometers in diameter, as representatively shown in FIG. 5(*d*). The microeutectic microstructure is very important because the very small size and homogeneous dispersion of the inter-metallic phase regions within the aluminum solid solution phase, allow the alloys to tolerate the heat and pressure of conventional powder metallurgy techniques without developing very coarse intermetallic phases that would reduce the strength and ductility of the consolidated article to unacceptably low levels.

As a result, alloys of the invention are useful for forming consolidated aluminum alloy articles. The alloys of the invention, however, are particularly advantageous because they can be compacted over a broad range of pressing temperatures and still provide the desired combination of strength and ductility in the compacted article. For example, one of the preferred alloys, nominal composition Al-12Fe-2V, can be compacted into a consolidated article having a hardness of at least 92 $R_B$ even when extruded at temperatures up to approximately 490° C. See FIG. 7.

Rapidly solidified alloys having the $Al_{bal}Fe_aX_b$ composition described above can be processed into particles by conventional comminution devices such as pulverizers, knife mills, rotating hammer mills and the like. Preferably, the comminuted powder particles have a size ranging from about −60 to 200 mesh.

The particles are placed in a vacuum of less than $10^{-4}$ torr($1.33\times10^{-2}$ Pa) preferably less than $10^{-5}$ torr ($1.33\times10^{-3}$ Pa), and then compacted by conventional powder metallurgy techniques. In addition, the particles are heated at a temperature ranging from about 300°-500° C., preferably ranging from about 325°-450° C., to preserve the microeutectic microstructure and minimize the growth or coarsening of the intermetallic phases therein. The heating of the powder particles preferably occurs during the compacting step. Suitable powder metallurgy techniques include direct powder rolling, vacuum hot compaction, blind die compaction in an extrusion press or forging press, direct and indirect extrusion, impact forging, impact extrusion and combinations of the above.

Figure 8:
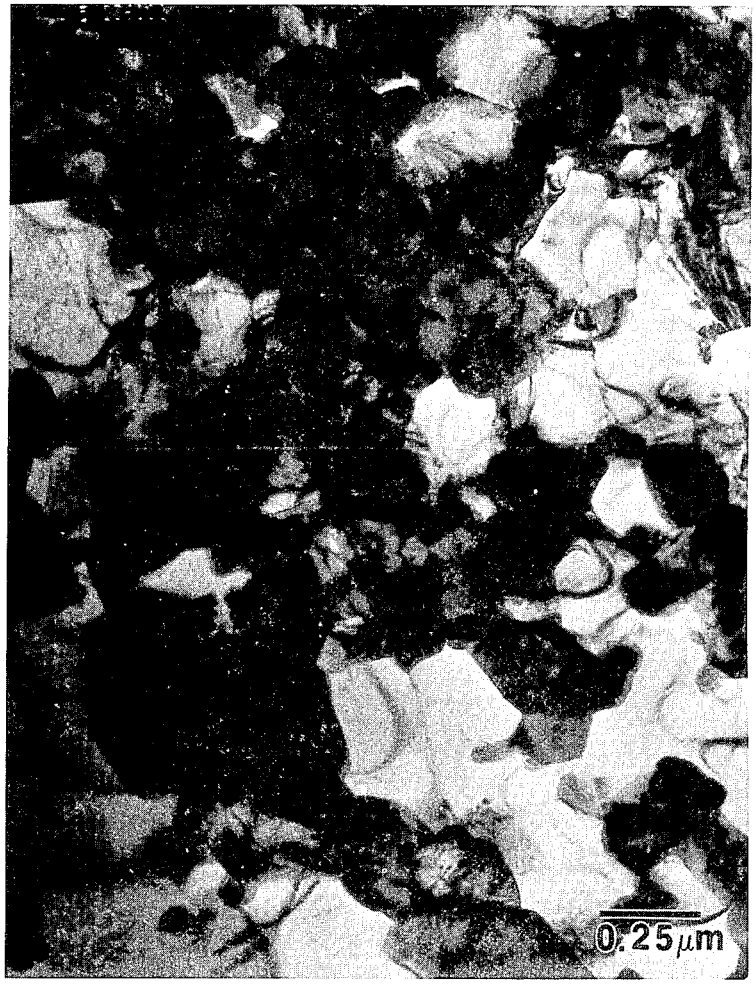
FIG. 8 shows an election micrograph of the microstructure of the consolidated article of the invention.

As representatively shown in FIG. 8, the compacted consolidated article of the invention is composed of an aluminum solid solution phase containing a substantially uniform distribution of dispersed, intermetallic phase precipitates therein. The precipitates are fine, irregularly shaped intermetallics measuring less than about 100 nm in all linear dimensions thereof; the volume fraction of these fine intermetallics ranges from about 25 to 45%. Preferably, each of the fine intermetallics has a largest dimension measuring not more than about 20 nm, and the volume fraction of coarse intermetallic precipitates (i.e. precipitates measuring more than about 100 nm in the largest dimension thereof) is not more than about 1%.

At room temperature (about 20° C.), the compacted, consolidated article of the invention has a Rockwell B hardness ($R_B$) of at least about 80. Additionally, the ultimate tensile strength of the consolidated article is at least about 550 MPa (80 ksi), and the ductility of the article is sufficient to provide an ultimate tensile strain of at least about 3% elongation. At approximately 350° C., the consolidated article has an ultimate tensile strength of at least about 240 MPa (35 ksi) and has a ductility of at least about 10% elongation.

Preferred consolidated articles of the invention have an ultimate tensile strength ranging from about 550 to 620 MPa (80 to 90 ksi) and a ductility ranging from about 4 to 10% elongation, when measured at room temperature. At a temperature of approximately 350° C., these preferred articles have an ultimate tensile strength ranging from about 240 to 310 MPa (35 to 45 ksi) and a ductility ranging from about 10 to 15% elongation.

The following examples are presented to provide a more complete understanding of the invention. The specific techniques, conditions, materials, proportions and reported data set forth to illustrate the principles and practice of the invention are exemplary and should not be construed as limiting the scope of the invention. All alloy compositions described in the examples are nominal compositions.

EXAMPLES 1 to 65

The alloys of the invention were cast with the method and apparatus of the invention. The alloys had an almost totally microeutectic microstructure, and had the microhardness values as indicated in the following Table 1.

TABLE 1

| # | NOMINAL ALLOY COMPOSITION | AS-CAST (20° C.) HARDNESS (VHN) Kg/mm$^2$ |
|---|---|---|
| 1 | Al—8Fe—2Zr | 417 |
| 2 | Al—10Fe—2Zr | 329 |
| 3 | Al—12Fe—2Zr | 644 |
| 4 | Al—11Fe—1.5Zr | 599 |
| 5 | Al—9Fe—4Zr | 426 |
| 6 | Al—9Fe—5Zr | 517 |

TABLE 1-continued

| # | NOMINAL ALLOY COMPOSITION | AS-CAST (20° C.) HARDNESS (VHN) Kg/mm$^2$ |
|---|---|---|
| 7 | Al—9.5—3Zr | 575 |
| 8 | Al—9.5Fe—5Zr | 449 |
| 9 | Al—10Fe—3Zr | 575 |
| 10 | Al—10Fe—4Zr | 546 |
| 11 | Al—10.5Fe—3Zr | 454 |
| 12 | Al—11Fe—2.5Zr | 440 |
| 13 | Al—9.5Fe—4Zr | 510 |
| 14 | Al—11.5Fe—1.5Zr | 589 |
| 15 | Al—10.5Fe—2Zr | 467 |
| 16 | Al—12Fe—4Zr | 535 |
| 17 | Al—10.5Fe—6Zr | 603 |
| 18 | Al—12Fe—5Zr | 694 |
| 19 | Al—13Fe—2.5Zr | 581 |
| 20 | Al—11Fe—6Zr | 651 |
| 21 | Al—10Fe—2V | 422 |
| 22 | Al—12Fe—2V | 365 |
| 23 | Al—8Fe—3V | 655 |
| 24 | Al—9Fe—2.5V | 518 |
| 25 | Al—10Fe—3V | 334 |
| 26 | Al—11Fe—2.5V | 536 |
| 27 | Al—12Fe—3V | 568 |
| 28 | Al—11.754Fe—2.5V | 414 |
| 29 | Al—10.5Fe—2V | 324 |
| 30 | Al—10.5Fe—2.5V | 391 |
| 31 | Al—10.5Fe—3.5V | 328 |
| 32 | Al—11Fe—2V | 360 |
| 33 | Al—10Fe—2.5V | 369 |
| 34 | Al—11Fe—1.5V | 551 |
| 35 | Al—8Fe—2Zr—1V | 321 |
| 36 | Al—8Fe—4Zr—2V | 379 |
| 37 | Al—9Fe—3Zr—2V | 483 |
| 38 | Al—8.5Fe—3Zr—2V | 423 |
| 39 | Al—9Fe—3Zr—3V | 589 |
| 40 | Al—9Fe—4Zr—2V | 396 |
| 41 | Al—9.5Fe—3Zr—2V | 510 |
| 42 | Al—9.5Fe—3Zr—1.5V | 542 |
| 43 | Al—10Fe—2Zr—1V | 669 |
| 44 | Al—10Fe—2Zr—1.5V | 714 |
| 45 | Al—11Fe—1.5Zr—1V | 519 |
| 46 | Al—8Fe—3Zr—3V | 318 |
| 47 | Al—8Fe—4Zr—2.5V | 506 |
| 48 | Al—8Fe—5Zr—2V | 556 |
| 49 | Al—8Fe—2Cr | 500 |
| 50 | Al—8Fe—2Zr—1Mo | 464 |
| 51 | Al—8Fe—2Zr—2Mo | 434 |
| 52 | Al—7.7Fe—4.6Y | 471 |
| 53 | Al—8Fe—4Ce | 400 |
| 54 | Al—7.7Fe—4.6Y—2Zr | 636 |
| 55 | Al—8Fe—4Ce—2Zr | 656 |
| 56 | Al—12Fe—4Zr—1Co | 737 |
| 57 | Al—12Fe—5Zr—1Co | 587 |
| 58 | Al—13Fe—2.5Zr—1Co | 711 |
| 59 | Al—12Fe—4Zr—0.5Zn | 731 |
| 60 | Al—12Fe—4Zr—1Co—0.5Zn | 660 |
| 61 | Al—12Fe—4Zr—1Ce | 662 |
| 62 | Al—12Fe—5Zr—1Ce | 663 |
| 63 | Al—12Fe—4Zr—1Ce—0.5Zn | 691 |
| 64 | Al—10Fe—2.5V—2Si | 356 |
| 65 | Al—9Fe—2.5V—1Si | 359 |

EXAMPLES 66 to 74

Alloys outside the scope of the invention were cast, and had corresponding microhardness values as indicated in Table 2 below. These alloys were largely composed of a primarily dendritic solidification structure with clearly defined dendritic arms. The dendritic intermetallics were coarse, measuring about 100 nm in the smallest linear dimensions thereof.

TABLE 2

| | Alloy Composition | As-Cast Hardness (VHN) |
|---|---|---|
| 66 | Al—6Fe—6Zr | 319 |
| 67 | Al—6Fe—3Zr | 243 |
| 68 | Al—7Fe—3Zr | 315 |

TABLE 2-continued

| | Alloy Composition | As-Cast Hardness (VHN) |
|---|---|---|
| 69 | Al—6.5Fe—5Zr | 287 |
| 70 | Al—8Fe—3Zr | 277 |
| 71 | Al—8Fe—1.5Mo | 218 |
| 72 | Al—8Fe—4Zr | 303 |
| 73 | Al—10Fe—2Zr | 329 |
| 74 | Al—12Fe—2V | 276 |

EXAMPLE 75

Figure 6:
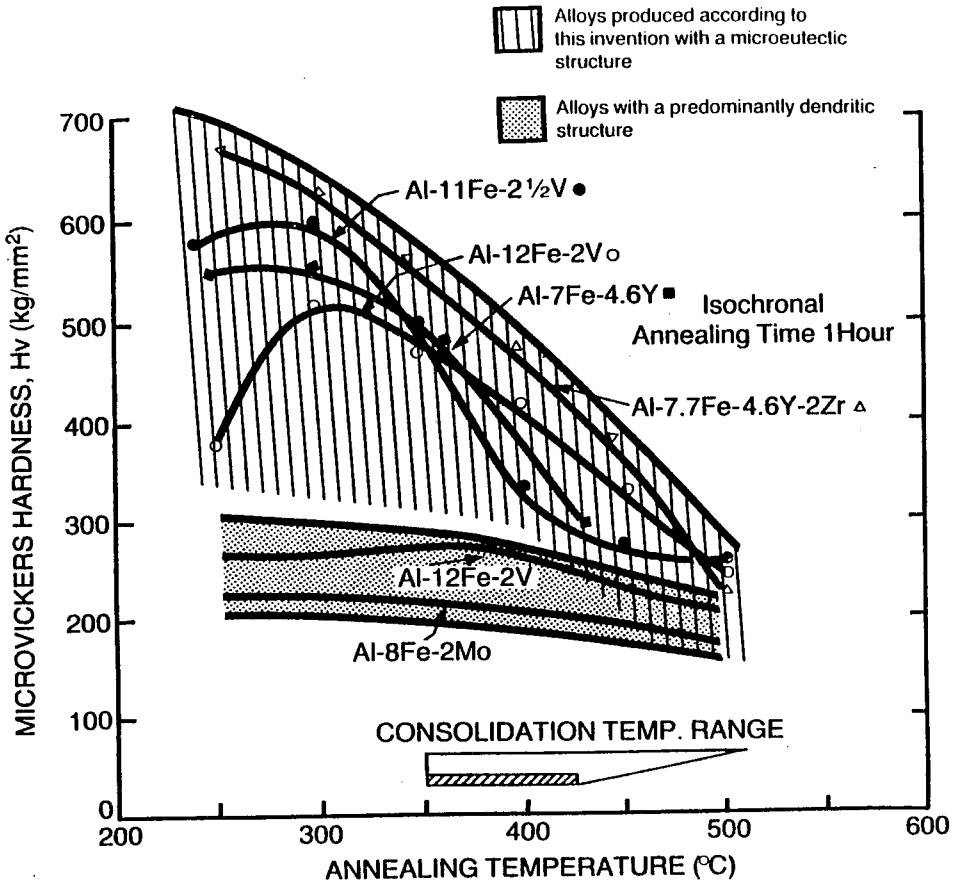
FIG. 6 shows plots of hardness versus isochronal annealing temperature for alloys of the invention.

FIG. 6, along with Table 3 below, summarizes the results of isochronal annealing experiments on (a) as-cast strips having approximately 100% microeutectic structure and (b) as-cast strips having a dendritic structure. The Figure and Table show the variation of microVickers hardness of the ribbon after annealing for 1 hour at various temperatures. In particular, FIG. 6 illustrate that alloys having a microeutectic structure are generally harder after annealing, than alloys having a primarily dendritic structure. The microeutectic alloys are harder at all temperatures up to about 500° C.; and are significantly harder, and therefore stronger, at temperatures ranging from about 300° to 400° C. at which the alloys are typically consolidated.

Alloys containing 8Fe-2Mo and 12Fe-2V, when produced with a dendritic structure, have room temperature microhardness values of 200–300 kg/m$^2$ and retain their hardness levels at about 200 kg/mm$^2$ up to 400° C. An alloy containing 8Fe-2Cr decreased in hardness rather sharply on annealing, from 450 kg/mm$^2$ at room temperature to about 220 kg/mm$^2$ (which is equivalent in hardness to those of Al-1.35Cr-11.59Fe and Al-1.33Cr-13Fe claimed by Ray et al.).

On the other hand, the alloys containing 7Fe-4.6Y, and 12Fe-2V went through a hardness peak approximately at 300° C. and then decreased down to the hardness level of about 300 kg/mm$^2$ (at least 100 kg/mm$^2$ higher than those for dendritic Al-8Fe-2Cr, Al-8Fe-2Mo and Al-8Fe-2V, and alloys taught by Ray et al.). Also, the alloy containing 8Fe-4Ce started at about 600 kg/mm$^2$ at 250° C. and decreased down to 300 kg/mm$^2$ at 400° C.

FIG. 6 also shows the microVickers hardness change associated with annealing Al-Fe-V alloy for 1 hour at the temperatures indicated. An alloy with 12Fe and 2V exhibits steady and sharp decrease in hardness from above 570 kg/mm$^2$ but still maintains 250 kg/mm$^2$ after 400° C. (750° F.)/1 hour annealing. Alloys claimed by Ray et al. (U.S. Pat. No. 4,347,076) could not maintain such high hardness and high temperature stability. Aluminum alloys containing 12Fe-5Zr, 11Fe-6Zr, 10Fe-2Zr-1V, and 8Fe-3V, all have microeutectic structures and hardness at room temperature of at least about 600 kg/mm$^2$ when cast in accordance with the invention. The present experiment also shows that for high temperature stability, about 1.5 to 5 wt % addition of a rare earth element; which has the advantageous valancy, size and mass effect over other transition elements; and the presence of more than 10 wt % Fe, preferably 12 wt % Fe, are important.

Figures 5A, 5B, 5C, 5D:
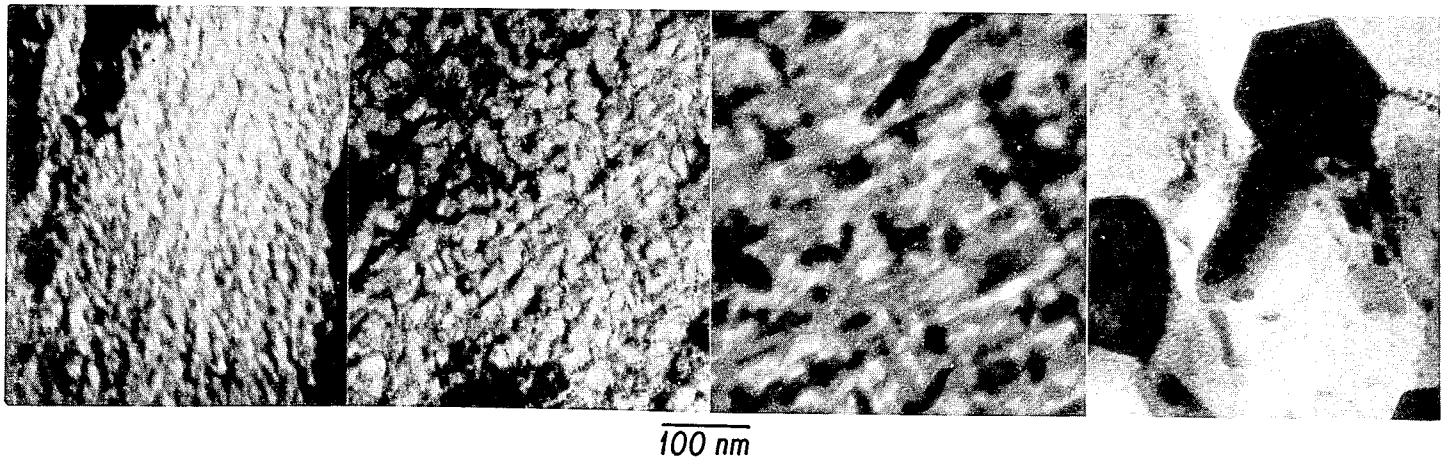
FIGS. 5 (*a*), (*b*), (*c*) and (*d*) show transmission electron micrographs of aluminum alloy microstructures after annealing.

Transmission electron microstructures of alloys of the invention, containing rare earth elements, which had been heated to 300° C., exhibit a very fine and homogeneous distribution of dispersoids inherited from the "microeutectic" morphology cast structure, as shown in FIG. 5(*a*). Development of this fine microstructure is responsible for the high hardness in these alloys. Upon heating at 450° C. for 1 hour, it is clearly seen that dispersoids dramatically coarsen to a few microns sizes (FIG. 5(*d*)) which was responsible for a decrease in hardness by about 200 kg/mm$^2$. Therefore, these alloy powders are preferably consolidated (e.g., via vacuum hot pressing and extrusion) at or below 450° C. to be able to take advantage of the unique alloy microstructure presently obtained by the method and apparatus of the invention.

TABLE 3

Microhardness Values (kg/mm$^2$) as a Function of Temperature For Alloys with Microeutectic Structure Subjected to Annealing for 1 hr.

| NOMINAL ALLOY COMPOSITION | Room Temp. | 250° | 300° C. | 350° C. | 450° C. |
|---|---|---|---|---|---|
| Al—8Fe—2Zr | 417 | 520 | | 358 | 200 |
| Al—12Fe—2Zr | 644 | 542 | | 460 | 255 |
| Al—8Fe—2Zr—1V | 321 | 535 | | 430 | 215 |
| Al—10Fe—2V | 422 | 315 | | 300 | 263 |
| Al—12Fe—2V | 365 | 350 | | 492 | 345 |
| Al—8Fe—3V | 655 | | 366 | 392 | 240 |
| Al—9Fe—2.5V | 518 | | 315 | 290 | 240 |
| Al—10Fe—3V | 334 | | 523 | 412 | 256 |
| Al—11Fe—2.5V | 536 | | 461 | 369 | 260 |
| Al—12Fe—3V | 568 | | 440 | 458 | 327 |
| Al—11.75Fe—2.5V | 414 | | | | |
| Al—8Fe—2Cr | 500 | 415 | | 300 | 168 |
| Al—8Fe—2Zr—1Mo | 464 | 495 | | 429 | 246 |
| Al—8Fe—2Zr—2Mo | 434 | 410 | | 510 | 280 |
| Al—7Fe—4.6Y | 471 | 550 | | 510 | 150 |
| Al—8Fe—4Ce | 634 | 510 | | 380 | 200 |
| Al—7.7Fe—4.6Y—2Zr | 636 | 550 | | 560 | 250 |
| Al—8Fe—4Ce—2Zr | 556 | 540 | | 510 | 250 |

EXAMPLE 76

Table 4A and 4B shows the mechanical properties measured in uniaxial tension at a strain rate of about $10^{-4}$/sec for the alloy containing Al-12Fe-2V at various elevated temperatures. The cast ribbons were subjected first to knife milling and then to hammer milling to produce −60 mesh powders. The yield of −60 mesh powders was about 98%. The powders were vacuum hot pressed at 350° C. for 1 hour to produce a 95 to 100% density preform slug, which was extruded to form a rectangular bar with an extrusion ratio of about 18 to 1 at 385° C. after holding for 1 hour.

TABLE 4A

Al—12Fe—2V alloy with primarily dendritic structure, vacuum hot compacted at 350° C. and extruded at 385° C. and 18:1 extrusion ratio.

| | STRESS | | FRACTURE |
|---|---|---|---|
| TEMPERATURE | 0.2% YIELD | UTS | STRAIN (%) |
| 24° C. | 538 MPa | 586 MPa | 1.8 |
| (75° F.) | (78.3 Ksi) | (85 Ksi) | 1.8 |
| 149° C. | 485 MPa | 505 MPa | 1.5 |
| (300° F.) | (70.4 Ksi) | (73.2 Ksi) | 1.5 |
| 232° C. | 400 MPa | 418 MPa | 2.0 |
| (450° F.) | (58 Ksi) | (60.7 Ksi) | 2.0 |
| 288° C. | 354 MPa | 374 MPa | 2.7 |
| (550° F.) | (51.3 Ksi) | (54.3 Ksi) | 2.7 |
| 343° C. | 279 MPa | 303 MPa | 4.5 |
| (650° F.) | (40.5 Ksi) | (44.0 Ksi) | 4.5 |

TABLE 4B

Al—12Fe—2V alloy with microeutectic structure vacuum hot compacted at 350° C. and extruded at 385° C. and 18:1 extrusion ratio.

| | STRESS | | FRACTURE |
|---|---|---|---|
| TEMPERATURE | 0.2% YIELD | UTS | STRAIN |
| 24° F. | 565 MPa | 620 MPa | 4% |

TABLE 4B-continued

Al—12Fe—2V alloy with microeutectic structure vacuum hot compacted at 350° C. and extruded at 385° C. and 18:1 extrusion ratio.

| TEMPERATURE | STRESS 0.2% YIELD | STRESS UTS | FRACTURE STRAIN |
|---|---|---|---|
| (75° F.) | (82 Ksi) | (90 Ksi) | 4% |
| 149° C. | 510 MPa | 538 MPa | 4% |
| (300° F.) | (74 Ksi) | (78 Ksi) | 4% |
| 232° C. | 469 MPa | 489 MPa | 5% |
| (450° F.) | (68 Ksi) | (71 Ksi) | 5% |
| 288° C. | 419 MPa | 434 MPa | 5.3% |
| (550° F.) | (60.8 Ksi) | (63 Ksi) | 5.3% |
| 343° C. | 272 MPa | 288 MPa | 10% |
| (650° F.) | (39.5 Ksi) | (41.8 Ksi) | 10% |

EXAMPLE 77

Table 5 below shows the mechanical properties of specific alloys measured in uniaxial tension at a strain rate of approximately $10^{-4}$/sec and at various elevated temperatures. A selected alloy powder was vacuum hot pressed at a temperature of 350° C. for 1 hour to produce a 95–100% density, preform slug. The slug was extruded into a rectangular bar with an extrusion ratio of 18 to 1 at 385° C. after holding for 1 hour.

TABLE 5

ULTIMATE TENSILE STRESS (UTS) KSI and ELONGATION TO FRACTURE ($E_f$) (%)

| | 75° F. | 350° F. | 450° F. | 550° F. | 650° F. |
|---|---|---|---|---|---|
| Al—10Fe—3V | | | | | |
| UTS | 85.7 | 73.0 | 61.3 | 50 | 40 |
| $E_f$ | 7.8 | 4.5 | 6.0 | 7.8 | 10.7 |
| Al—10Fe—2.5V | | | | | |
| UTS | 85.0 | 70.0 | 61.0 | 50.5 | 39.2 |
| $E_f$ | 8.5 | 5.0 | 7.0 | 9.7 | 12.3 |
| Al—9Fe—4Zr—2V | | | | | |
| UTS | 87.5 | 69.0 | 62.0 | 49.3 | 38.8 |
| $E_f$ | 7.3 | 5.8 | 6.0 | 7.7 | 11.8 |
| Al—11Fe—1.5Zr—1V | | | | | |
| UTS | 84 | 66.7 | 60.1 | 47.7 | 37.3 |
| $E_f$ | 8.0 | 7.0 | 8.7 | 9.7 | 11.5 |

EXAMPLE 78

Figure 7:
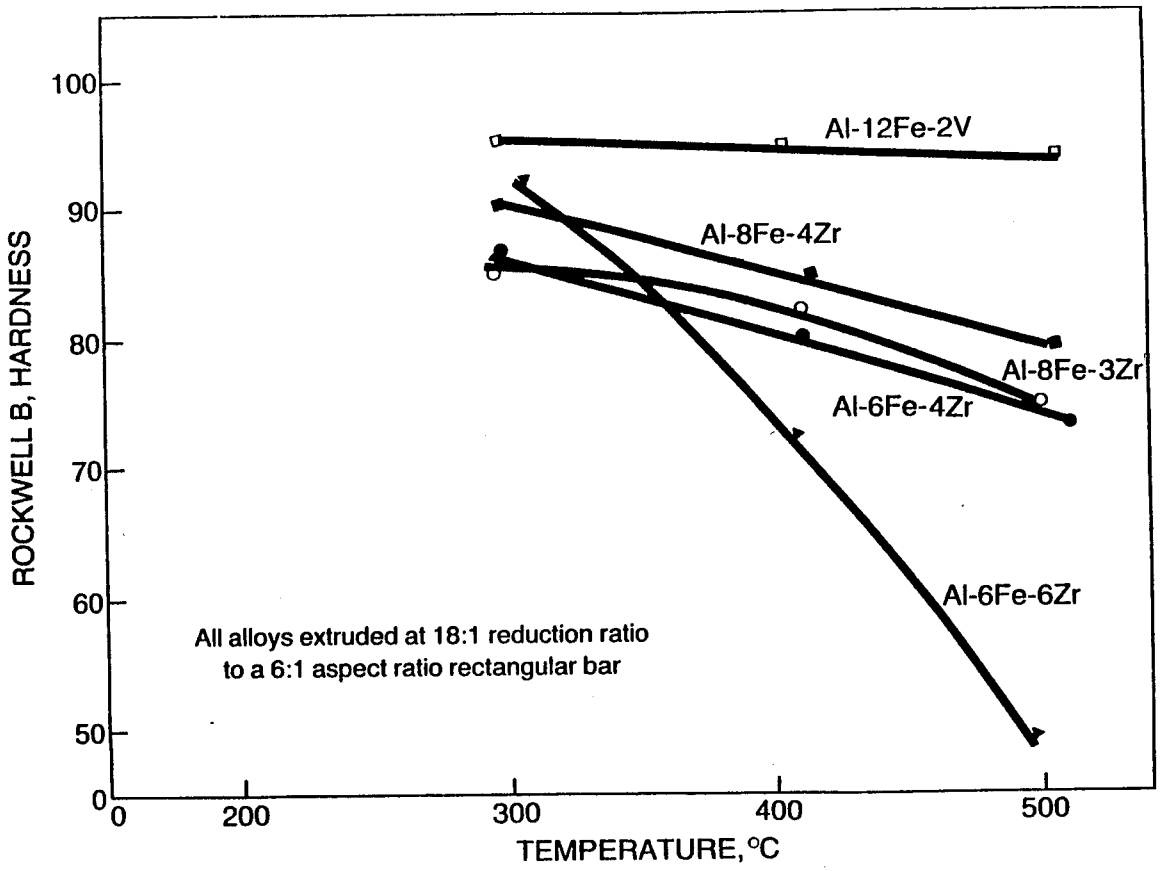
FIG. 7 shows a plot of the hardness of an extruded bar composed of selected alloys as a function of extrusion temperature.

Important parameters that affect the mechanical properties of the final consolidated article include the composition, the specific powder consolidation method, (extrusion, for example,) and the consolidation temperature. To illustrate the selection of both extrusion temperature and composition, FIG. 7, shows the relationship between extrusion temperature and the hardness (strength) of the extruded alloy being investigated. In general, the alloys extruded at 315° C. (600° F.) all show adequate hardness (tensile strength); however, all have low ductility under these consolidation conditions, some alloys having less than 2% tensile elongation to failure, as shown in Table 6 below. Extrusion at higher temperatures; e.g. 385° C. (725° F.) and 485° C. (900° F.); produces alloys of higher ductility. However, only an optimization of the extrusion temperature (e.g. about 385° C.) for the alloys, e.g. Al12Fe-2V and Al-8Fe-3Zr, provides adequate room temperature hardness and strength as well as adequate room temperature ductility after extrusion. Thus, at an optimized extrusion temperature, the alloys of the invention advantageously retain high hardness and tensile strength after compaction at the optimum temperatures needed to produce the desired amount of ductility in the consolidated article. Optimum extrusion temperatures range from about 325° to 450° C.

TABLE 6

ULTIMATE TENSILE STRENGTH (UTS) KSI and ELONGATION TO FRACTURE ($E_f$) %, BOTH MEASURED AT ROOM TEMPERATURE; AS A FUNCTION OF EXTRUSION TEMPERATURE

| Alloy | Extrusion Temperature 315° C. | 385° C. | 485° C. |
|---|---|---|---|
| Al—8Fe—3Zr | | | |
| UTS | 66.6 | 68.5 | 56.1 |
| $E_f$ | 5.5 | 9.1 | 8.1 |
| Al—8Fe—4Zr | | | |
| UTS | 67.0 | 71.3 | 65.7 |
| $E_f$ | 4.8 | 7.5 | 1.5 |
| Al—12Fe—2V | | | |
| UTS | 84.7 | 90 | 81.6 |
| $E_F$ | 1.8 | 4.0 | 3.5 |

EXAMPLE 79

The alloys of the invention are capable of producing consolidated articles which have a high elastic modulus at room temperature and retain the high elastic modulus at elevated temperatures. Preferred alloys are capable of producing consolidated articles which have an elastic modulus ranging from approximately 100 to 70 GPa (10 to $15\times10^3$ KSI) at temperatures ranging from about 20° to 400° C.

Table 7 below shows the elastic modulus of an Al-12Fe-2v alloy article consolidated by hot vacuum compaction at 350° C., and subsequently extruded at 385° C. at an extrusion ratio of 18:1. This alloy had an elastic modulus at room temperature which was approximately 40% higher than that of conventional aluminum alloys. In addition, this alloy retained its high elastic modulus at elevated temperatures.

TABLE 7

ELASTIC MODULUS OF Al—12Fe—2V

| Temperature | Elastic Modulus |
|---|---|
| 20° C. | 97 GPa ($14\times10^6$ psi) |
| 201° C. | 86.1 GPa ($12.5\times10^6$ psi) |
| 366° C. | 76 GPa ($11\times10^6$ psi) |

Having thus described the invention in rather full detail, it will be understood that these details need not be strictly adhered to but that various changes and modifications may suggest themselves to one skilled in the art, all falling within the scope of the invention as defined by the subjoined claims.

We claim:

1. An aluminum-base alloy consisting essentially of the formula $Al_{bal}Fe_aX_b$, wherein X is at least one element selected from the group consisting of Zn, Co, Ni, Cr, Mo, V, Zr, Ti, Y, Si and Ce, "a" ranges from about 7–15 wt %, "b" ranges from about 1.5–10 wt % and the balance is aluminum, said alloy having a microstructure which is at least about 70% microeutectic.

2. An alloy as recited in claim 1, wherein said alloy has an as-cast hardness of at least about 320 kg/mm$^2$ at room temperature.

3. An aluminum-base alloy as recited in claim 2, wherein said alloy has a microstructure which is at least about 90% microeutectic.

4. An aluminum alloy as recited in claim 1, wherein said alloy has a microstructure which is approximately 100% micreutectic.

5. An apparatus for forming rapidly solidified metal within an ambient atmosphere, comprising:

(a) a movable casting surface which has a quenching region for solidifying molten metal thereon;

(b) reservoir means for holding molten metal, said reservoir means having orifice means for depositing a stream of molten metal on said casting surface quenching region;

(c) heating means for heating molten metal contained in said reservoir;

(d) gas means for providing a non-reactive gas atmosphere at said quenching region to minimize oxidation of said deposited metal;

(e) conditioning means for disrupting a moving gas boundary layer carried along by said moving casting surface to minimize disturbances of said molten metal stream that would inhibit quenching of the molten metal on the casting surface.

6. An apparatus as recited in claim 3, wherein said gas means comprises a gas housing coaxially located around said reservoir to conduct and direct said gas toward said quenching region.

7. An apparatus as recited in claim 3, wherein said conditioning means comprises:

a high velocity gas jet spaced from said reservoir in a direction counter to the direction of casting surface movement and directed toward said movable casting surface to strike and disrupt the moving gas boundary layer carried along by the casting surface and thereby minimize disturbance of said molten metal stream by said boundary layer.

8. A method for casting metal strip in an ambient atmosphere, comprising of steps of:

moving a casting surface, which is adapted to quench and solidify molten metal thereon, at a selected velocity;

depositing a stream of molten metal onto a quenching region of said casting surface to solidify said molten metal at a quench rate of at least about $10^{6°}$ C./sec;

providing a non-reactive gas atmosphere at said quenching region to minimize oxidation of said deposited metal;

disrupting a moving gas boundary layer carried along by said moving casting surface to minimize disturbances of said molten metal stream that would inhibit the quenching of the molten metal on the casting surface.

9. A method as recited in claim 6, wherein said disrupting step comprises the steps of directing a high velocity jet of gas toward said boundary layer; and impacting said boundary layer with said gas jet at a location spaced from said quenching region in a direction counter to the direction of casting surface movement to thereby disrupt said boundary layer.

10. A method for forming a consolidated metal alloy article, comprising the steps of:

compacting particles composed of an aluminum-base alloy consisting essentially of the formula $Al_{bal}Fe_aX_b$, wherein X is at least one element selected from the group consisting of Zn, Co, Ni, Cr, Mo, V, Zr, Ti, Y, Si and Ce, "a" ranges from about 7–15 wt %, "b" ranges from about 1.5–10 wt % and the balance is Al, said alloy having a microstructure which is at least about 70% microeutectic; and heating said particles in a vacuum during said compacting step to a temperature ranging from about 300° to 500° C.

11. A method as recited in claim 10, which said heating step comprises heating said particles to a temperature ranging from about 325° to 450° C.

12. A consolidated metal article compacted from particles of an aluminum-base alloy having a microeutectic microstructure and consisting essentially of the formula $Al_{bal}Fe_aX_b$, wherein X is at least one element selected from the group consisting of Zn, Co, Ni, Cr, Mo, V, Zr, Ti, Y, Si and Ce, "a" ranges from about 7 to 15 wt %, "b" ranges from about 1.5 to 10 wt %, and the balance is Al;

said consolidated article composed of an aluminum solid solution phase containing therein a substantially uniform distribution of dispersed, intermetallic phase precipitates, wherein said precipitates are fine intermetallics measuring less than about 100 nm in all dimensions thereof.

13. A consolidated metal article as recited in claim 12, wherein said article is compacted from aluminum alloy particles having a microstructure which is at least about 90% microeuectic.

14. A consolidated metal article as recited in claim 12, wherein the volume fraction of said fine intermetallics ranges from about 25 to 45%.

15. A consolidated metal article as recited in claim 12, wherein each of said fine intermetallics has a largest dimension measuring not more than about 20 nm.

16. A consolidated metal article as recited in claim 12, wherein the volume fraction of coarse intermetallic precipitates, measuring more than about 100 nm in the lartest dimension thereof, is not more than about 1%.

17. A consolidated metal article as recited in claim 12, wherein said consolidated article has a combination of an ultimate tensile strength of at least about 550 MPa and an ultimate tensile strain of at least about 3% elongation when measured at room temperature.

18. A consolidated metal article as recited in claim 17, further having a combination of an ultimate tensile strength of at least about 240 MPa and an ultimate tensile strain of at least about 10% elongation when measured at a temperature of approximately 350° C.

19. A consolidated metal article as recited in claim 12, wherein said article has an elastic modulus ranging from approximately 100 to 70 GPa at temperatures ranging from about 20° to 400° C.

* * * * *